United States Patent [19]

Sterlicchi et al.

[11] 4,040,626

[45] Aug. 9, 1977

[54] BALL AND PUCK GAME

[76] Inventors: Pasquale Sterlicchi; Helen Sterlicchi, both of 1-J Kimberton Marrows Road, Newark, Del. 19713

[21] Appl. No.: 684,303

[22] Filed: May 7, 1976

[51] Int. Cl.[2] ..... A63B 63/04

[52] U.S. Cl. ..... 273/123 R; 273/126 R; 273/127 B

[58] Field of Search ..... 273/127 B, 127 C, 127 R, 273/126 R, 120, 121 R, 124 R, 95 D, 5 R, 123 R

[56] References Cited

U.S. PATENT DOCUMENTS

| | | | |
|---|---|---|---|
| 1,942,280 | 1/1934 | Fohmann | 273/105 R |
| 2,067,732 | 1/1937 | Rimmer | 273/95 D |
| 2,069,487 | 1/1937 | Van Riper | 273/95 E |
| 2,595,649 | 5/1952 | Eistetter | 273/118 R |
| 2,724,594 | 11/1955 | Anderson | 273/95 D |
| 3,647,215 | 3/1972 | Sterlicchi et al. | 273/123 R |
| 3,653,666 | 4/1972 | Barlow et al. | 273/126 R |

*Primary Examiner*—Richard G. Pinkham
*Assistant Examiner*—Lawrence Everett Anderson
*Attorney, Agent, or Firm*—Abramo & Abramo

[57] ABSTRACT

This game consists primarily of a platform, having angled support members and a hinged back wall, the back wall and platform portion having groups of spaced apart openings, which are in both the platform and back wall, so as to freely receive balls, and when the game is used for pucks, the back wall is pivoted rearwards, and the openings will receive plugs, so as to support the pucks.

1 Claim, 7 Drawing Figures

BALL AND PUCK GAME

This invention relates to competitive games, and more particularly to a ball and puck game.

It is, therefore, the principal object of this invention to provide a ball and puck game, which will be novel, by the playing action being fast at all times.

Another object of this invention is to provide a ball and puck game, which will consist of platform means, having inscribed thereon playing areas which are terminated by openings at one end, the openings being partially in the platform, as well as in a hinged back panel.

A further object of this invention is to provide a game of the type described, which will be adaptable for use with balls and, when desired, may be used with pucks, when the back panel is hinged rearwardly and circular plugs are circularly urged into the openings, so as to form support for pucks.

A further object of this invention is to provide a game of the type described, which is adaptable for being played at home, and in other areas.

A still further object of this invention is to provide a game of the type described, which will employ a baseball bat or club, a hard or soft ball, or a rubber puck.

Other objects of the invention are to provide a ball and puck game, which is simple in design, inexpensive to manufacture, rugged in construction, easy to use and efficient in use.

These and other objects will be readily evident upon a study of the following specification and the accompanying drawing, wherein.

Figures 1, 2, 3, 4, 5, 6, 7:
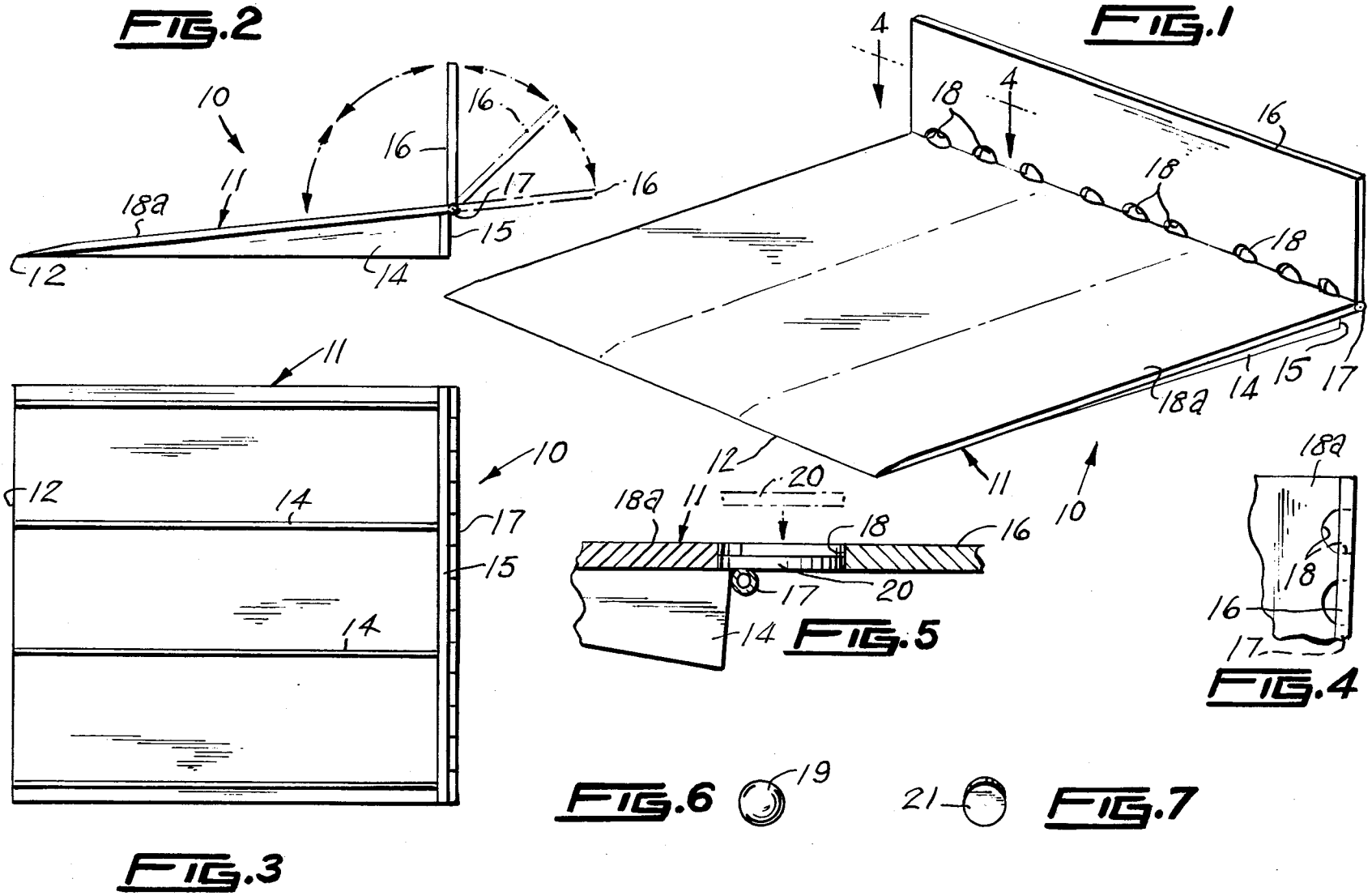
FIG. 1 is a perspective view of a game comprising the present invention.
FIG. 2 is a side view of FIG. 1, shown in elevation with some of the rear panel positions shown in phantom lines.
FIG. 3 is a bottom plan view of FIG. 1.
FIG. 4 is a fragmentary view, taken along the line 4—4 of FIG. 1.
FIG. 5 is an enlarged fragmentary side elevation of FIG. 1, showing the rear panel folded downwards, with a removable plug in place, in the openings that intersect both the back panel and the platform.
FIG. 6 is a plan view of one of the balls for playing the game.
FIG. 7 is a perspective view of a puck that may be used with the invention.

According to this invention, a game 10 is shown to include a rectangular platform 11, which is inclined and provided with a tapered front edge 12. Removably secured to the underside platform 11, are a plurality of tapered support members 14 which are terminated at the large end by means of a rear wall 15. A back panel 16 is secured by hinge means 17 to the rear wall 15, as is more readily shown in FIG. 2 of the drawing. A group of spaced apart openings 18 extend partially through back panel 16, and also extend through top surface 18*a* of platform 11. A ball 19 is used to play game 10, and is struck by means of a suitable bat. When it is desired, plugs 20 are urged into the openings 18, so so as to support pucks 21. The back panel 16 is tilted rearwards, in order to play with the pucks 21.

It shall be noted that the openings 18, if desired, may be smaller or larger, and may be higher, according to league ruling.

It shall also be noted that the back panel 16 may be pivoted, and set at any angle, to make it easier or harder for a player to score points. Game 10 may be made of various materials, and carpet texture material is used to cover the center non-scoring area, and is also used to cover the top section playing area, so as to keep the balls 19 from bouncing too much, as the players try to score points. The balls 19, after passing through openings 18, may be registered by electronic means, if desired, and netting (not shown) is used for the back-stop.

The weight and diameter of balls 19 and pucks 21 may vary, so as to regulate the speed of the balls 19 and pucks 21. The team colors for game 10, must be red and blue and all the equipment and suits, hard-hats, and cover of all units must represent each team-color.

Game 10 is playable by having one person in each letter section scoring area, and he or she will be responsible for losing, and scoring points for the team and themselves. Each person must play within his designated letter section scoring area. Any time a player crosses over a line to another player's section, he or she will then be disqualified for interfering, and will be replaced by extra team player.

All teams in the league should have two extra players, for replacement in case of emergencies, and there will be two referees any time a game is played, so as to enforce all the rules and regulations.

While various changes may be made in the detail construction and method of playing game 10, it shall be understood that such changes shall be within the spirit and scope of the present invention, as is defined by the appended claims;

What I claim is:

1. A combination ball and puck game, comprising a platform, a back panel which is adjustable and hinged to said platform so as to provide adjustment of the inclination of said panel, the combination having opening means for receiving a ball or puck, support members removably secured to said platform, and removable plug means insertable in said opening means for supporting pucks, wherein said opening means comprise spaced apart openings through said back panel and alignable complementary opening portions through said platform, said openings and opening portions freely receiving ball means for playing said game, and said opening portions complementing said spaced apart openings so that said opening means are circular in configuration when said back panel is pivoted downward to align with the plane of said platform, and said opening means removably receiving, frictionally, said plug means which will support pucks when said panel is aligned with the platform, said plugs being circular and placed in a recessed manner within said openings.

* * * * *